US007373957B2

(12) United States Patent
Heger et al.

(10) Patent No.: US 7,373,957 B2
(45) Date of Patent: May 20, 2008

(54) PAPERMAKING SCREEN

(75) Inventors: Wolfgang Heger, Nideggen (DE); Klaus Fichter, Juchen (DE)

(73) Assignee: Andreas Kufferath GmbH & Co. KG, Düren (DE)

( * ) Notice: Subject to any disclaimer, the term of this patent is extended or adjusted under 35 U.S.C. 154(b) by 75 days.

(21) Appl. No.: 10/530,724

(22) PCT Filed: Oct. 24, 2003

(86) PCT No.: PCT/EP03/11776

§ 371 (c)(1),
(2), (4) Date: Apr. 8, 2005

(87) PCT Pub. No.: WO2004/046458

PCT Pub. Date: Jun. 3, 2004

(65) Prior Publication Data

US 2006/0162804 A1 Jul. 27, 2006

(30) Foreign Application Priority Data

Nov. 16, 2002 (DE) ..... 102 53 491

(51) Int. Cl.
*D21F 1/10* (2006.01)
*D21F 7/08* (2006.01)
*D03D 25/00* (2006.01)

(52) U.S. Cl. ..... 139/383 A; 162/358.2; 162/348; 162/900; 162/903

(58) Field of Classification Search ..... 139/383 A; 162/358.2, 900
See application file for complete search history.

(56) References Cited

U.S. PATENT DOCUMENTS 4,705,601 A 11/1987 Chiu
4,729,412 A * 3/1988 Bugge ..... 139/383 A
5,238,536 A 8/1993 Danby
5,482,567 A * 1/1996 Barreto ..... 139/383 A (Continued)

FOREIGN PATENT DOCUMENTS

DE 42 29 828 A1 3/1994

(Continued)

*Primary Examiner*—Gary L. Welch
*Assistant Examiner*—Robert H Muromoto, Jr.
(74) *Attorney, Agent, or Firm*—Roylance, Abrams, Berdo & Goodman, L.L.P.

(57) ABSTRACT

A papermaking screen includes at least one individual fabric for the paper side and at least one individual fabric for the machine side. Each of those fabrics is provided with a set of weft yarns (4, 6) and warp yarns (1, 5). At least one part of the superimposed individual fabrics is interconnected via binder yarns (3). The two fabric layers (paper side and machine side) are connected by binder yarns that are fully integrated into the fabric structure of the paper side and are able to support the resulting binding point due to each binder yarn (3) engaging with warp yarns (1) of the individual fabric from above at defined points on the paper side, while at least one weft yarn (2) of the individual fabric engages with the warp yarns (1) from below on the opposite side so as to lean against it such that the binder yarns remain on one plane along with the weft and the remaining warp yarns. This arrangement results in a high-strength papermaking screen which has very good dewatering power and a regular structure.

17 Claims, 4 Drawing Sheets

U.S. PATENT DOCUMENTS

| | | | | |
|---|---|---|---|---|
| 5,518,042 | A | 5/1996 | Wilson | |
| 5,826,627 | A * | 10/1998 | Seabrook et al. | 139/383 A |
| 6,533,901 | B2 * | 3/2003 | Taipale | 162/348 |
| 6,581,645 | B1 * | 6/2003 | Johnson et al. | 139/383 A |
| 6,810,917 | B2 * | 11/2004 | Stone | 139/383 A |
| 6,905,574 | B2 * | 6/2005 | Festor | 162/348 |
| 6,920,902 | B2 * | 7/2005 | Majaury et al. | 139/383 A |
| 6,926,043 | B2 * | 8/2005 | Quigley et al. | 139/383 A |
| 6,978,809 | B2 * | 12/2005 | Quigley | 139/383 A |
| 7,007,722 | B2 * | 3/2006 | Quigley et al. | 139/383 A |
| 7,048,829 | B2 * | 5/2006 | Heger et al. | 162/348 |
| 7,048,830 | B2 * | 5/2006 | Heger et al. | 162/348 |

FOREIGN PATENT DOCUMENTS

| | | |
|---|---|---|
| WO | WO 99/06630 A1 | 2/1999 |
| WO | WO 99/06632 A1 | 2/1999 |

* cited by examiner

PAPERMAKING SCREEN

FIELD OF THE INVENTION

The present invention relates to a papermaking screen having at least one single fabric for the paper side and at least one single fabric for the machine side. Each fabric has a set of weft yarns and warp yarns. At least a part of the stacked individual fabrics are connected to each other by binder yarns.

BACKGROUND OF THE INVENTION

Use is increasingly made today in the papermaking industry of high-performance papermaking machines running at speeds of up to 2000 m/min and with operating widths exceeding 10 m. As a very general rule, the sheet forming unit is configured as a twin-wire former, in many instances as a gap former. In typical machines, the sheet forming process takes place immediately in a relatively short dewatering zone between two papermaking screens. The time for sheet formation is reduced to a few milliseconds because of this short distance and the high output rate. The solid content or dry content of the fiber suspension must be raised from about 1 percent to about 20 percent over this interval. This operation requires the papermaking screens to possess high dewatering capability without leaving marks in the paper and with providing high fiber support.

Another important point is the cross-directional stability of screen tension, which is decisive in determination of the thickness and moisture content profile of the sheet. Very high and precise requirements have been set for this stability in the case of modern machines operating with great sheet widths. Consequently, use is increasingly being made in the sheet forming zone of forming strips mounted on the machine sides of the screens and pressed against them to improve the forming. This use results in rapidly changing deflection of the fabric of the screens in the longitudinal direction.

There are basically two different approaches in the state of the art to solve the problem of meeting these requirements, and in particular to effect binding together of the individual fabrics of the paper side and the machine side. One solution is characterized in that the two individual fabric layers are connected to each other together by a weft or transverse yarn. Another solution provides that the connecting is effected by a longitudinal or warp yarn. However, the known approaches are now unsuitable if it is desired to employ different warp diameters on the machine and paper sides.

If the configuration of the two individual fabrics accordingly is oriented especially toward a fine paper side with small diameters and a coarse machine side with large diameters in order to arrive at high stability values, connecting of the two layers must be effected by a weft, a binding weft in particular. The state of the art offers corresponding proposals for solution of this problem as well.

Hence the possibility exists of interweaving the two individual fabrics by an additional binding or stitching yarn which belongs neither to the binding pattern of the upper fabric (paper side) nor to that of the lower fabric (machine side). Such a solution is disclosed, for example, for the papermaking screen of U.S. Pat. No. 5,238,536, which provides a linen binding and a five-shank binding for the lower fabric. There are also approaches involving additional stitching yarns which simultaneously effect connecting of the two fabric layers and in addition serve as filling threads. Such a solution is disclosed in U.S. Pat. No. 5,518,042, for example.

In such disclosed solutions, the additionally used binder yarns alter the inherently homogeneous upper side. In a practical application, this leads to some extent to undesirable marks in the paper. To counter this result, the binder yarns are made to be increasingly thinner, but this has the disadvantage that the service life of the connection of individual fabric layers is correspondingly shortened. In addition, practical application has shown that "looping through" of the binding weft yarns may occur, this resulting in separation of the individual layers and rendering the fabric unusable.

In another disclosed solution, complete upper wefts are replaced by pairs of binding structural yarns. Depending on the type of fabric, the ratio of true upper wefts made by weft or warp yarns to the binding weft pairs varies. For example, PCT publications WO 99/06630 and WO 99/06632 disclose fabrics in which the upper fabric is made as a type of linen binding by combining two binding weft yarns. The lower fabric in turn is in these disclosed solutions in the form of a five-shank binding.

Despite the good interconnection of the two individual fabrics, the disclosed solutions present the essential disadvantage that the upper warp of the paper side is not supported at the points of intersection of the binding wefts. If the course of a "complete" upper weft in these solutions is considered, it is seen that both yarns are positioned at an elevated level as a result of alternate binding of upper weft and upper warp, with the result that both the warp and weft bends are positioned in one plane. As a result of use of the binding pairs, this support is now absent from all intersections and all yarns absorb the main forces along their respective longitudinal axis which at the intersections is oriented in the direction of the interior of the fabric. This disadvantage of absence of support arises especially when upper weft and binding pair are introduced in alternating sequence, so that, for example, a complete upper weft follows a binding pair which is then followed by an upper weft. To produce the preferably disclosed linen binding, the following upper weft must extend above the warp yarn which was previously positioned above the intersection and as a result is additionally pulled into the interior of the fabric. The result is that either every other upper warp yarn is positioned deeper in the fabric or none of the warp yarns may be positioned at the level of the weft yarns. This arrangement leads to uneven progress of the fabric on the paper side, something which may result in undesirable marks in the paper.

SUMMARY OF THE INVENTION

Objects of the present invention are to provide a papermaking screen characterized by high stiffness values, in particular a high degree of cross-directional stability, and affording dewatering output comparable to that of the disclosed solutions and helping prevent formation of marks in the paper.

These objects are basically attained by a papermaking screen where the respective binder yarn extends above warp yarns of the individual fabric at specific points on the paper side, below which at least one weft yarn of this individual fabric extends on the opposite side. Connection of the two fabric layers (paper side and machine side) is in turn effected by binder yarns which are then nevertheless fully integrated into the fabric structure of the paper side and in the process support the binding point by the special type of connection in such a way that the binder yarns remain on one plane with the wefts and the remaining warp yarns. Application of this binding concept results in production of a papermaking screen having a high degree of stiffness, possessing good dewatering properties and uniform structure, on the paper side in particular, so that undesirable marks in the paper are prevented.

As a result of the present invention, the warp yarns are supported from below by the associated weft yarns of the individual fabric of the paper side at points at which the warp yarns are pulled into the interior of the fabric by the binder yarn. The functional separation of upper and binding weft also makes it possible to employ for the upper weft (paper side) a material which supports the cross-directional stability of the fabric, such as a polyester material. Both materials are of the same type in the solutions referred to in the foregoing in use of a binding weft pair and require optimization with respect to connection of the layers, use customarily being made of polyamides. Although only one binder yarn is used in a given plane of the present invention, the number of binding points, and accordingly contact between binding weft and upper and/or lower chains of paper side and machine side, are not reduced in comparison to the disclosed solutions.

In one especially preferred embodiment of the papermaking screen of the present invention, provision is made such that the diameter of the binder yarn corresponds to that of the upper weft, resulting in a high degree of stiffness of binding of the fabric layers.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
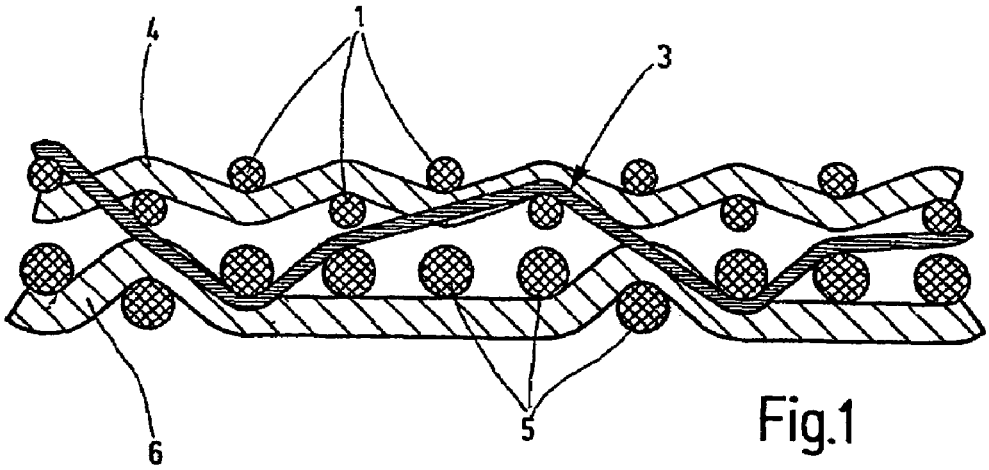
FIGS. 1 and 2 are diagrammatic, end elevational views in section of two conventional papermaking screens with binding solutions.

The following numeral identifications are employed in all the illustrations:

1 upper warp
2 upper weft (with binding weft)
3'3 binding weft
4 upper weft
5 lower warp
6 lower weft
7 extension above
8 extension below
9 extension above through lower weft 6

In FIG. 1, the conventional papermaking screen, as viewed in FIG. 1, has two individual fabrics, the upper individual fabric or upper fabric forming the paper side and the individual fabric positioned below it representing the bottom side or lower fabric. The upper individual fabric is formed of a set of weft yarns 2 as upper weft yarns and warp yarns 1 as upper warp yarns. The machine side located underneath also has a set of weft yarns 6 as lower weft yarns and warp yarns 5 as lower warp yarns. The disclosed screen has a linen bond as the binding type for the paper side. The lower fabric is configured as a five-shank fabric with respect to a repeat. As FIG. 1 shows, the two individual fabrics are connected to each other by a binding weft yarn 3. A plurality of such binding weft yarns (not shown) are positioned in sequence so as to extend into the plane of the drawing and out of it. Thus, the connection of the individual fabric layers necessary for the papermaking screen is effected. In these disclosed screens, the binder yarns 3 are used in the direction of the fabric in advance of and beyond the upper weft yarns 2 to effect connection of the individual fabric layers. Such binder yarn alters the actually very homogenous upper side of the paper side of the screen disadvantageously such that in practical application undesired marks may appear in the paper. For the binding weft yarns 3 accordingly to be disturbed as little as possible, they are made to be increasingly thinner, so that, when the disclosed papermaking screens are used, separation of the individual fabric layers may occur and accordingly failure of the screen as such.

Figure 2:
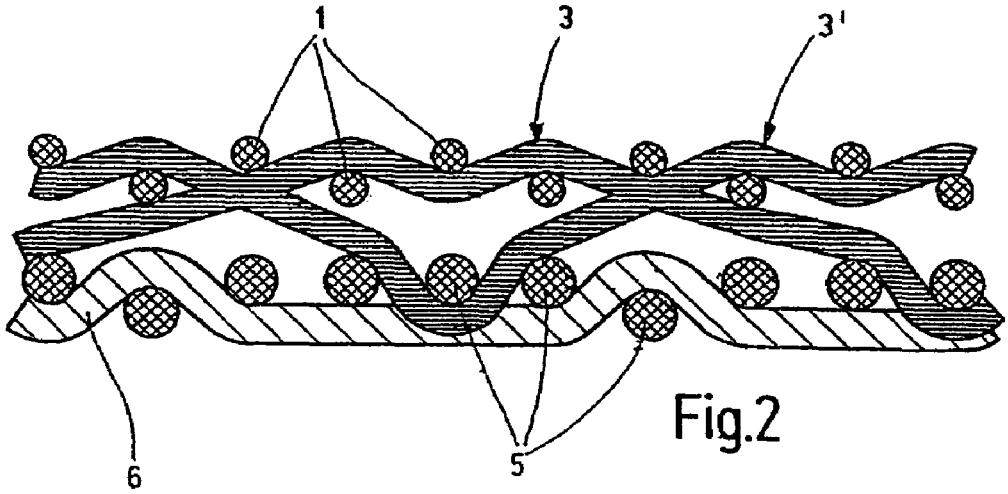

In the other disclosed screen shown in FIG. 2, two binding weft yarns 3 and 3' accordingly are used. The diameter of those weft yarns is selected to be greater than the diameter of the binding weft yarn 3 shown in FIG. 1. As a result of use of the two binding weft yarns 3 and 3' no complete upper weft is present then in these places any longer. The linen binding of the upper side rather is affected through the combination of the two binder yarns 3, 3'. In this instance as well, only a part of the papermaking screen is shown in section. A plurality of binder yarns 3 and 3' are present in sequence in different possible drawing planes. A significant disadvantage is to be seen in this screen in that the upper warp yarns 1 are not supported at the intersections of binder yarns 3 and 3'. In the case of this solution, irregularities occur and accordingly also marks in the paper with respect to the paper side of the screen, since, in order for the linen binding to be effected, the next upper weft must extend above the warp yarn, which previously was positioned above the intersection and consequently in addition is pulled into the interior of the fabric. Either every other upper warp yarn is positioned deeper in the fabric or none of the warp yarns are at the level of the weft yarns, resulting in the disadvantages described.

The papermaking screen of the present invention will now be described below. For the sake of simplicity and greater ease of understanding, the same reference numerals are used for the following illustrations of solutions, as well as for the conventional screens described in the foregoing.

Figure 3:
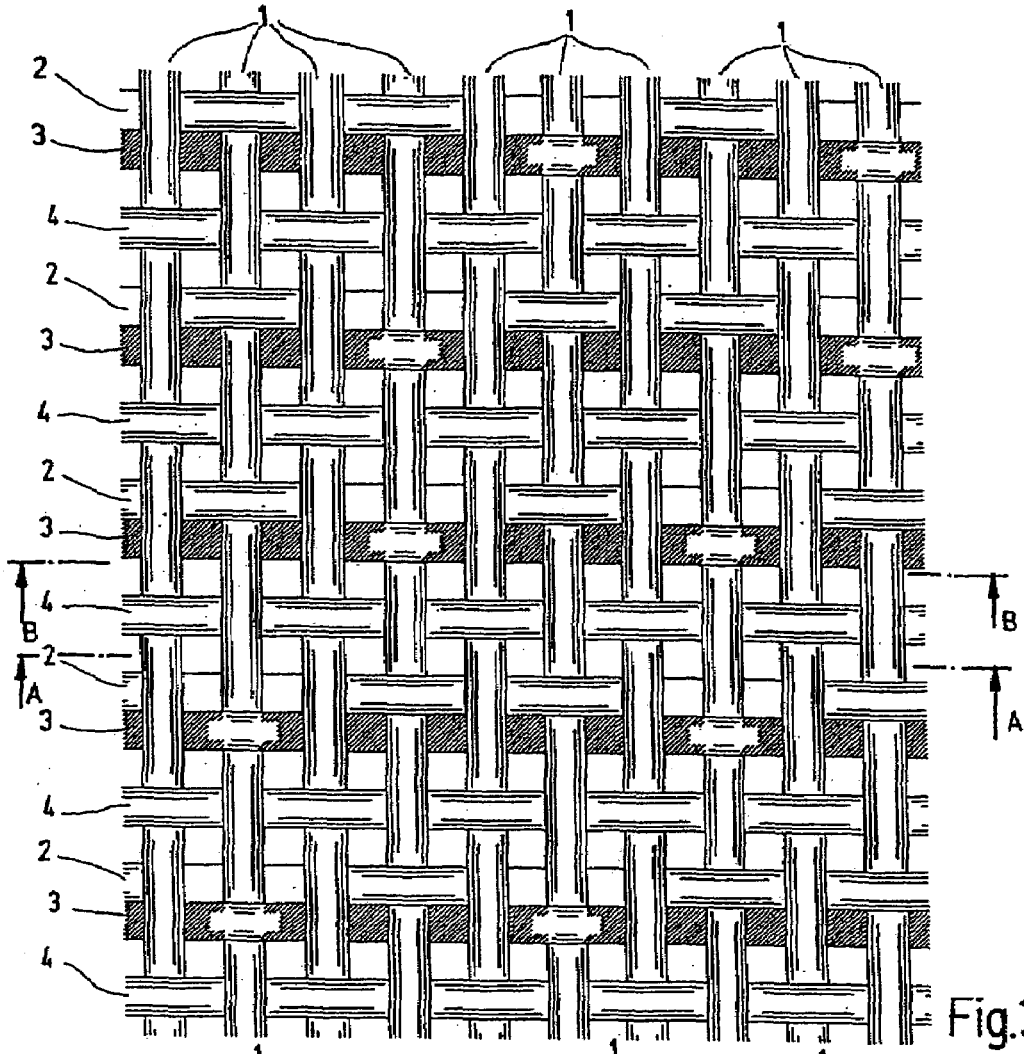
FIG. 3 is a top plan view of a portion of the upper or paper side of a papermaking screen according to a first embodiment of the present invention.
Figure 4:
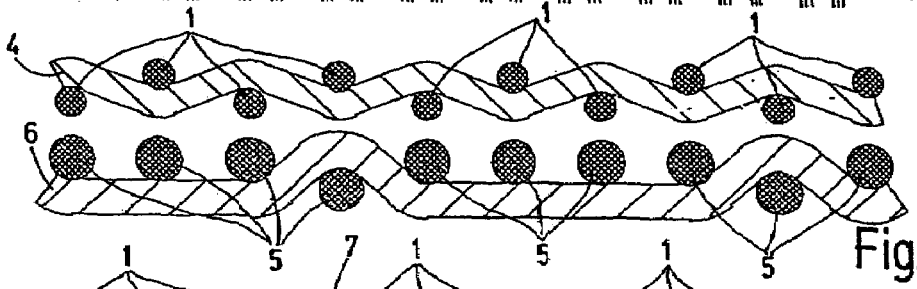
FIG. 4 is an end elevational view in section taken along line A-A of FIG. 3.
Figure 5:
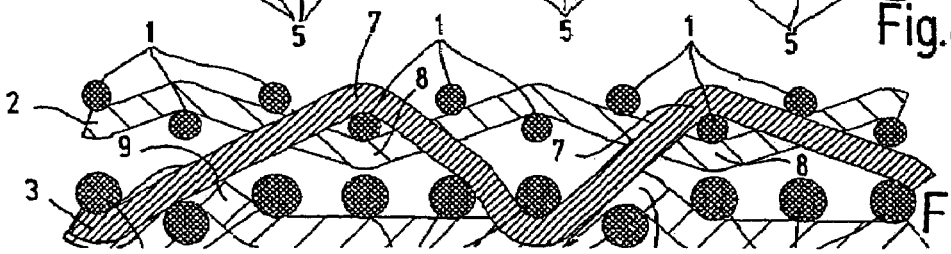
FIG. 5 is an end elevational view in section taken along line B-B in FIG. 3.

The first exemplary embodiment of a papermaking screen as shown in FIGS. 3, 4, and 5 is provided on the paper side with linen binding. On the lower side or machine side, it is configured as a five-shank bond. FIG. 3 presents a top view of a section of the upper or paper side of the papermaking screen of the present invention, and section A-A shown in FIG. 4 is presented as a view of the upper weft without binding weft, while section B-B in FIG. 5 is a view of the upper weft with binding weft as shown in FIG. 3.

FIG. 5 in particular shows how connection of the two individual fabrics for paper and machine side is affected by binder yarns 3. By way of example, the progress of such a binder yarn 3 is shown in the form of a section in FIG. 5. This binder yarn is fully integrated into the fabric structure on the paper side, in that on the paper side the respective binder yarn 3 extends above the associated warp yarns 1 of the individual fabric at specific points. At least one weft yarn 2 of this individual fabric extends below these warp yarns 1 on the side opposite the latter. This extension or point above or below is indicated in FIG. 5 by reference numerals 7 and 8. As a result of such arrangement, in which the associated binder yarn 3 extends above a warp yarn 1 and the associated upper weft yarn 2 extends below it, the binding point is supported from the direction of the opposite side, this ensuring that this binding point will remain on one plane with the other weft and warp yarns 4 and 1. Consequently, the upper weft yarn 2 also extends uniformly at the point at which the fabric binding has been effected without being bound into the lower fabric. Only at points at which the binding weft 3 extends above the upper warp is a brief exchange of upper weft 2 and binding weft 3 carried out. As a result, the warp yarns 1 positioned in between are supported from below by the upper weft yarn 2, as seen in FIG. 5, at the points at which these yarns 1 are pulled through the binder yarn 3 into the interior of the fabric. A contribution also is made to support by the warp yarns 5, of greater diameter, of the lower weft 6, especially the lower warp yarn 5, which is positioned vertically below the warp yarn 1 above and below which binder yarns extend.

Also in FIG. 5, the respective binding weft yarn 3 defines at the point of extension above 7 of the associated warp yarn 1 an angle with the latter. The measurement of that angle equals that of the weft yarn 2 extending below at this point. These angular measurements range from 90° to 130° in these areas, as a function of the configuration of the papermaking screen. As a result of these angular measurements, a sort of roof pane is created, both on the side of extension above 7 and in the opposite direction at the point of extension below 8. This situation has a favorable effect with respect to the binding pattern and the overall pattern of forces of the papermaking screen.

The binding of the present invention, configured as a five-shank binding with respect to a repeat, provides that the weft yarns 6 extend below four warp yarns 5 and above a following warp yarn 5. The respective binding weft yarn 3 rises obliquely from the lower fabric to the upper fabric at the point of this extension above 9. The respective binding weft yarn 3 is essentially of the same diameter as that of the respective weft yarn 2 of the individual fabric on the paper side. In addition, the warp yarns 5 and weft yarns 6 of the lower fabric, that is, on the machine side, are of a diameter larger than that of the associated yarn systems on the upper or paper side of the papermaking screen. With respect to the upper or paper side of the screen, the respective extension above 7 of the respective binder yarn 3 is separated in sequence from a weft yarn 2 by three warp yarns 1 positioned between them. At the point of the center, warp yarn 1 of this group of three the binding weft yarn 3 executes extension below yarn 6, a short distance in advance of the extension above 9, with a warp yarn 5 positioned underneath. As a result of the functional separation of upper weft yarns 2 of the upper fabric and binding weft yarns 3, these two sets of yarns may be formed of different materials. Preferably, the upper weft yarns 2 are formed of a polyester material and the binding weft yarn 3 are formed of a polyamide material, for the purpose of increasing the cross-directional stability of the screen.

The upper weft yarn 4 shown in FIG. 4 corresponds in configuration to the upper weft yarn 2 with binding weft yarn 3 positioned upstream from it as illustrated. The difference in numbering was selected exclusively for the sake of better understanding of the top view of the fabric pattern shown in FIG. 3.

Figure 6:
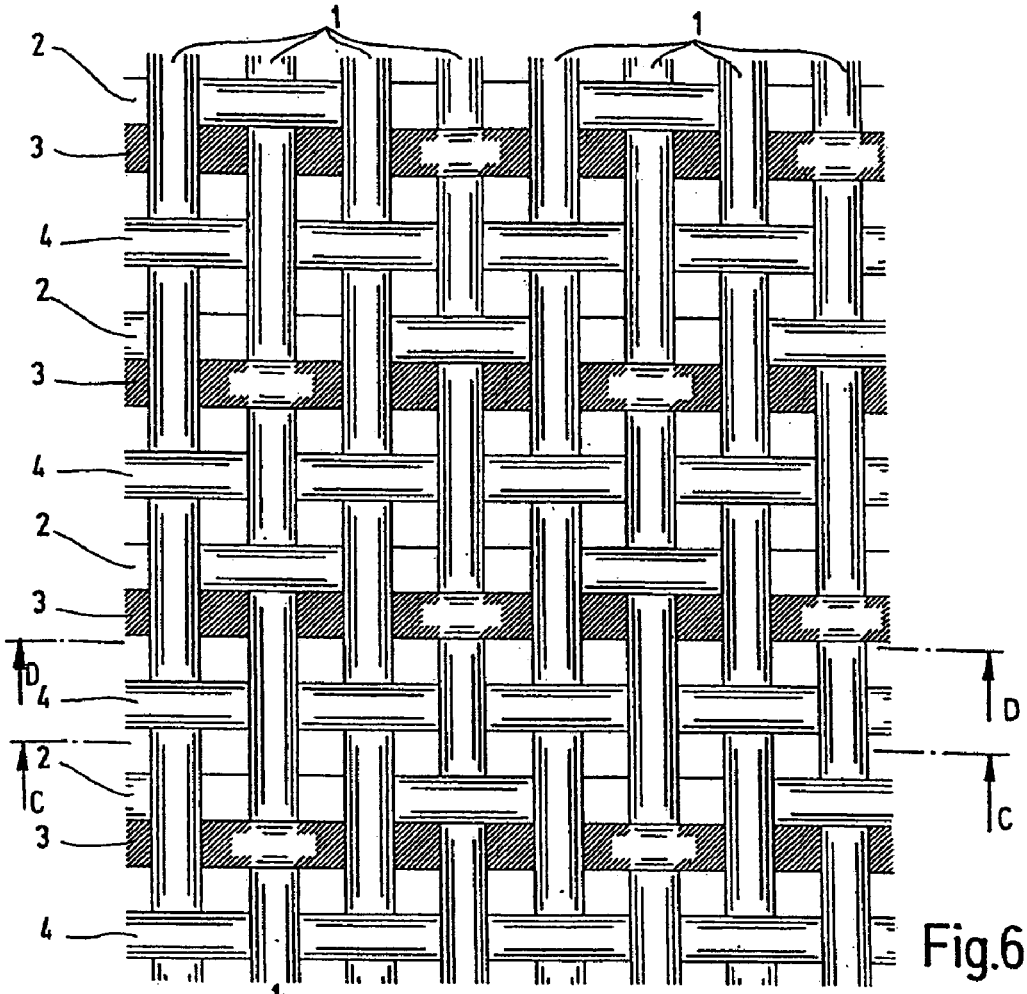
FIG. 6 is a top plan view of the upper or paper side of a papermaking screen according to a second embodiment of the present invention.
Figure 7:
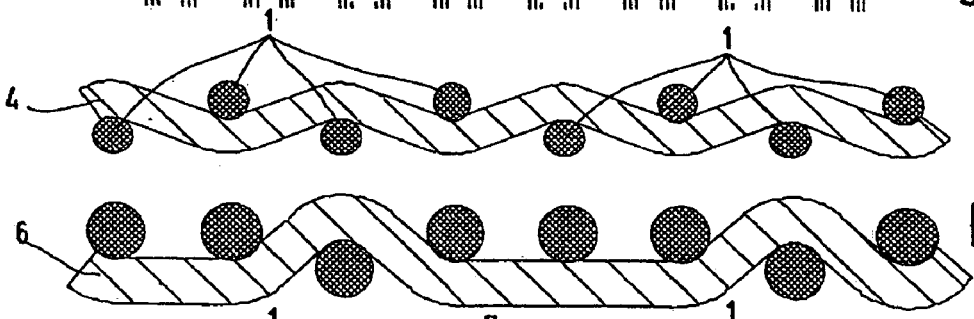
FIG. 7 is an end elevational view in section taken along line C-C of FIG. 6.
Figure 8:
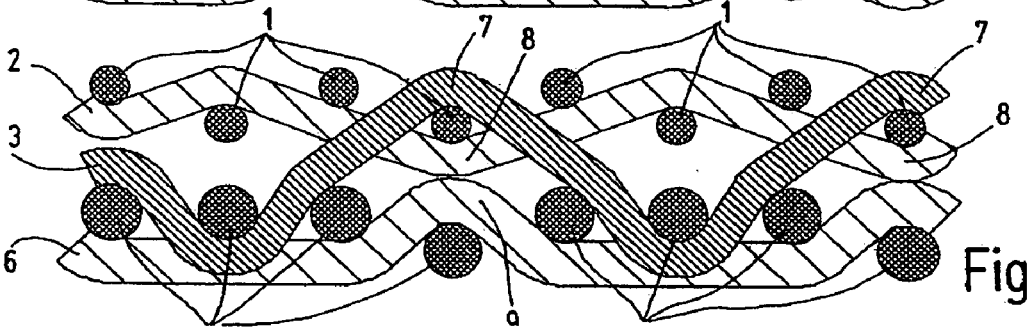
FIG. 8 is an end elevational view in section taken along line D-D of FIG. 6.

The modified embodiment shown in FIGS. 6, 7, and 8, this embodiment corresponds largely to the first embodiment initially described, except that a four-shank binding is used here for the lower fabric or lower side (machine side) in place of a five-shank lower side. In the respective four-shank binding shown in FIG. 8, the warp yarn 1 above, which the binder yarn 3 extends and below which upper weft yarn 2 extends, is in turn supported by a warp yarn 5 positioned below it of the lower fabric. The lower weft yarn 6 extends above the lower warp yarn 5 at the point of support. The binder yarn 3 is then tied in for the lower fabric in the area of three consecutive lower warp yarns 5. The binder yarn 3 extends above the central lower weft yarn 5 of a group of three and above two adjacent lower warp yarns 5. The roof-like configuration in the area of extension above 7 for the upper warp yarn 1 has corresponding to it in parallel a configuration in the form of extension 9 of the lower weft yarn 6 above the supporting lower warp yarn 5.

Figure 9:
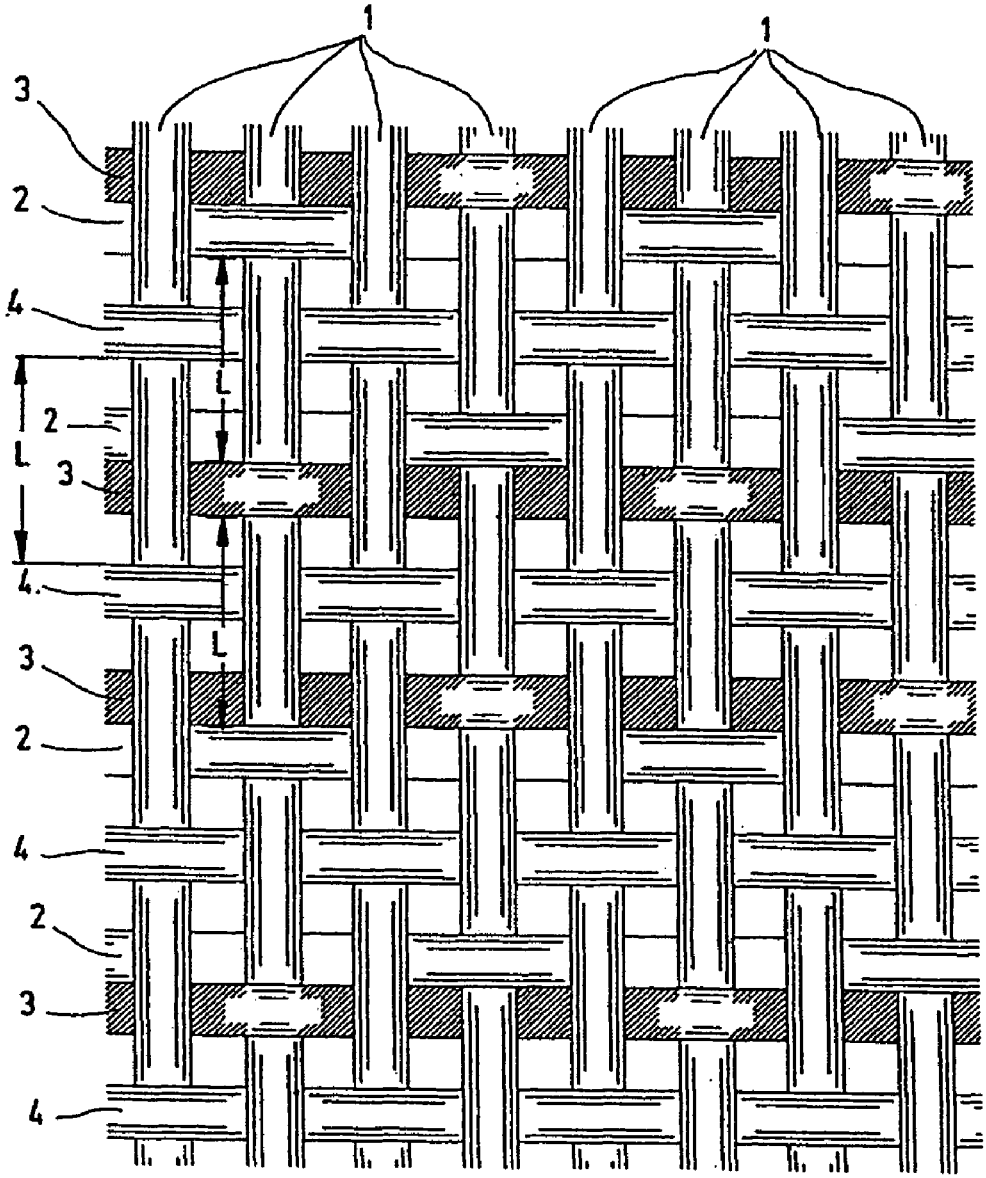
FIG. 9 is a top view of the upper or paper side of a papermaking screen according to a third embodiment of the present invention, corresponding to the first embodiment, but executed with an alternating weft sequence of the upper weft and binding weft.

In the embodiment illustrated in FIG. 9, the sequence of upper weft 2 with binder yarn 3 is changed, with the result that all floats of the warp yarns 1 are of the same length L on the upper side despite the arrangement of the binding points so as to be easily displaced toward each other. This arrangement makes certain that the warp bends are positioned in one plane on the upper side, in both the transverse and the longitudinal directions, and has a favorable effect in view of slight possible marking of the paper and of the high degree of stiffness of the screen.

A high degree of stability is achieved with the papermaking screen solution of the present invention. The screen is characterized by very good dewatering output and its production is cost-effective.

While various embodiments have been chosen to illustrate the invention, it will be understood by those skilled in the art that various changes and modifications can be made therein without departing from the scope of the invention as defined in the appended claims.

What is claimed is:

1. A papermaking screen, comprising:

a paper side individual fabric having a set of upper weft yarns and upper warp yarns;

a machine side individual fabric having a set of lower weft yarns and lower warp yarns and being positioned below said paper side individual fabric; and binder weft yarns connecting said fabrics and extending above said upper warp yarns at first points where adjoining ones of said upper weft yarns extend below said upper warp yarns, said first points of said binder weft yarns being separated by groups of three of said upper warp yarns, said binder weft yarns extending below said lower warp yarns at locations of central ones of said groups of three of said upper warp yarns.

2. A papermaking screen according to claim 1 wherein only a first type of said binding connects said fabrics.

3. A papermaking screen according to claim 1 wherein said paper side individual fabric is configured as linen binding; and at said first points, said binding weft yarns form angles equal to angles formed by said adjoining ones of said upper weft yarns where said upper weft yarns extend below said upper warp yarns.

4. A papermaking screen according to claim 1 wherein said machine side individual fabric comprises a multiple shank binding;

one of sets of three and four of said lower warp yarns extend above said lower weft yarns and sets of one of said lower warp yarns extend below said lower weft yarn at second points; and said binding weft yarns extend from said machine side individual fabric to said paper side individual fabric at one of spaced from said second points and at said second points.

5. A papermaking screen according to claim 4 wherein sets of three of said lower warp yarns extend above said lower weft yarns.

6. A papermaking screen according to claim 4 wherein sets of four of said lower warp yarns extend above said lower weft yarns.

7. A papermaking screen according to claim 1 wherein said binding weft yarns have diameters essentially equal to diameters of said upper weft yarns.

8. A papermaking screen according to claim 1 wherein said binding weft yarns are supported by upper wet yarns at said first points, and extend between said upper weft yarns and said lower weft yarns.

9. A papermaking screen comprising:

a paper side individual fabric having a set of upper weft yarns formed of polyester material and upper warp yarns;

a machine side individual fabric having a set of lower weft yarns and lower warp yarns and being positioned below said paper side individual fabric; and binder weft yarns formed of a polyamide material connecting said fabrics and extending above said upper warp yarns at first points where adjoining ones of said upper weft yarns extend below said upper warp yarns, said upper weft yarns and said binding weft yarns being separate and formed of different materials;

whereby cross-directional stability is increased.

10. A papermaking screen according to claim 9 wherein only a first type of said binding weft yarns connects said fabrics.

11. A papermaking screen according to claim 9 wherein said paper side individual fabric is configured as linen binding; and at said first points, said binding weft yarns form angles equal to angles formed by said adjoining ones of said upper welt yarns where said upper weft yarns extend below said upper warp yarns.

12. A papermaking screen according to claim 9 wherein said machine side individual fabric comprises a multiple shank binding;

one of sets of three and four of said lower warp yarns extend above said lower weft yarns and sets of one of said lower warp yarns extend below said lower weft yarn at second points; and said binding weft yarns extend from said machine side individual fabric to said paper side individual fabric at one of spaced from said second points and at said second points.

13. A papermaking screen according to claim 12 wherein sets of three of said lower warp yarns extend above said lower weft yarns.

14. A papermaking screen according to claim 12 wherein sets of four of said lower warp yarns extend above said lower weft yarns.

15. A papermaking screen according to claim 9 wherein said binding weft yarns have diameters essentially equal to diameters of said upper weft yarns.

16. A papermaking screen according to claim 9 wherein said binding weft yarns are supported by upper weft yarns at said first points, and extend between said upper weft yarns and said lower weft yarns.

17. A papermaking screen comprising:

a paper side individual fabric having a set of upper weft yarns and upper warp yarns;

a machine side individual fabric having a set of lower weft yarns and lower warp yarns and being positioned below said paper side individual fabric;

binder weft yarns connecting said fabrics and extending above said upper warp yarns at first points where adjoining ones of said upper weft yarns extend below said upper warp yarns, said upper weft yarns and said binding weft yarns being separate and formed of different materials, said first points of said binder weft yarns being separated by groups of three of said upper warp yarns, said binder weft yarns extending below said lower warp yarns at locations of central ones of said groups of three of said upper warp yarns.

* * * * *